US006037552A

United States Patent [19]

Yamada

[11] Patent Number: 6,037,552

[45] Date of Patent: Mar. 14, 2000

[54] SEE-SAW BUTTON DEVICE FOR ELECTRONIC EQUIPMENT

[75] Inventor: Hiroshi Yamada, Shizuoka, Japan

[73] Assignee: NEC Corporation, Japan

[21] Appl. No.: 09/177,339

[22] Filed: Oct. 22, 1998

[30] Foreign Application Priority Data

Oct. 24, 1997 [JP] Japan ..... 9-292081

[51] Int. Cl.[7] ..... H01H 21/24

[52] U.S. Cl. ..... 200/339; 200/557

[58] Field of Search ..... 200/5 R, 6 R, 200/6 B, 6 BA, 16 R, 17 R, 18, 553, 557, 558, 561, 573, 339, 574

[56] References Cited

U.S. PATENT DOCUMENTS

| | | | |
|---|---|---|---|
| 3,588,409 | 6/1971 | Lattinen | 200/153 LA |
| 3,639,705 | 2/1972 | Rayner | 200/6 A |
| 4,429,200 | 1/1984 | Glenn et al. | 200/153 T |
| 5,622,254 | 4/1997 | Lee | 200/557 |
| 5,642,806 | 7/1997 | Karadimas | 200/557 |

FOREIGN PATENT DOCUMENTS

| | | | |
|---|---|---|---|
| 62-98124 | 6/1987 | Japan | H01H 23/30 |
| 62-147233 | 9/1987 | Japan | H01H 23/30 |
| 63-254629 | 10/1988 | Japan | H01H 21/00 |
| 63-184530 | 11/1988 | Japan | H01H 23/14 |
| 64-2331 | 1/1989 | Japan | H01H 23/14 |
| 1-173526 | 7/1989 | Japan | H01H 23/30 |
| 4-29139 | 3/1992 | Japan | H01H 23/24 |
| 4-169019 | 6/1992 | Japan | H01H 23/30 |
| 4-179014 | 6/1992 | Japan | H01H 23/16 |

*Primary Examiner*—Michael Friedhofer
*Attorney, Agent, or Firm*—Ostrolenk, Faber, Gerb & Soffen, LLP

[57] ABSTRACT

A see-saw button device for electronic equipment includes rates a box fitted with a button, and a board mounted with switches. The button has two press portions on it. Shafts serving as a see-saw fulcrum of the button are provided along a rib formed at an intermediate portion of the two button press portions. The two switches each having an operating portion on an end face thereof are mounted on the board such that their operating portions oppose each other. The two switches are separated by a distance larger than a thickness of the rib of the button.

5 Claims, 10 Drawing Sheets

SEE-SAW BUTTON DEVICE FOR ELECTRONIC EQUIPMENT

BACKGROUND OF THE INVENTION

1. Field of the Invention

The present invention relates to a see-saw button device used in electronic equipment, e.g., a pager, a cellular phone, a scroll button, or an individual radio selective calling receiver.

2. Description of the Prior Art

Conventionally, see-saw button devices for electronic equipment are disclosed in, e.g., Japanese Unexamined Patent Publication No. 1-173526, Japanese Unexamined Utility Model Publications Nos. 64-02331 and 63-184530, Japanese Unexamined Patent Publication No. 62-147233, Japanese Unexamined Utility Model Publication No. 62-98124, Japanese Unexamined Patent Publication Nos. 4-179014, 4-169019, and 63-254629, and Japanese Unexamined Utility Model Publication No. 4-29139.

FIGS. 1A and 1B are perspective views of a conventional see-saw switch described in Japanese Utility Model Publication No. 4-29139 before assembly, in which FIG. 1A shows a button, and FIG. 1B shows a housing into which the button is to be pressed.

The see-saw switch shown in FIGS. 1A and 1B is constituted by a housing 21, a button 22, and press members 30. A semicircular projection 24 and bendable pawls 25 are formed on the bottom surface of the housing 21. The button 22 is constituted by notches 28 for receiving the pawls 25, and guides 29 integrally formed with the notches 28 and having steps. The button 22 is pressed into the housing 21 and is mounted on it by bending the pawls 25. The press members 30 press switches 23 under the button 22. The conventional see-saw button device having the above arrangement has problems as follows.

(1) The switches are juxtaposed and the switch operating portions are located immediately below button press ribs. At least a distance for the operating portions of the switches is required. Therefore, the button becomes inevitably large. In other words, the button press surface becomes large.

(2) Since the switches are arranged between the board and the button and housing, at least a space corresponding to the thickness of the switches must be reserved between the board and the button and housing. Namely, the thickness of the device increases.

(3) Since the operating portions of the switches are located immediately below the button press surface, the button press surface may be undesirably pressed at two portions simultaneously to turn on both the right and left switches undesirably.

SUMMARY OF THE INVENTION

The present invention has been made in consideration of the above situation, and has as its object to provide a see-saw button device for electronic equipment, in which the button can be made compact, the device can be made thin, and the switches can be prevented from being simultaneously pressed.

In order to achieve the above object, the present invention is characterized by including a box fitted with a button and a board mounted with switches, wherein the button has two press portions thereon, shafts serving as a see-saw fulcrum of the button are provided along a rib formed at an intermediate portion of the two button press portions, the two switches each having an operating portion on an end face thereof are mounted on the board such that the operating portions oppose each other, and the two switches are separated by a distance larger than a thickness of the rib of the button.

The present invention is characterized by having cantilevered elastic members and a contact portion, the cantilevered elastic members projecting from two sides of the rib of the button in a see-saw operating direction and each of the cantilevered elastic members having a size not larger than that of a button press surface, the contact portion being formed in a notch where the button of the box is to be mounted, and at least one of the cantilevered elastic members being constantly in contact with the contact portion.

The present invention is characterized in that a lower surface of at least one of the elastic members of the button is constantly in contact with an upper surface of the contact portion of the box.

The present invention is characterized in that the switches are formed on a lower surface of the board.

The present invention is characterized in that the button is point-symmetrical with respect to a center of a press surface thereof.

The present invention is characterized in that groove bearings to fit with the shafts as the see-saw fulcrum, which are formed along the rib of the button, are formed on the box.

The see-saw button device for the electronic equipment according to the present invention has excellent effects as follows.

(1) In the present invention, the switches are operated by a rib located at a portion interposed between the two button pressing portions of the see-saw button. No button press rib need be provided independently of this rib, so that the button can be made compact.

(2) In the present invention, the operating portions on the side surfaces of the switches are pressed by rightward and leftward operations of the rib located at the portion interposed between the two button press portions of the see-saw button. The switches can be mounted on the lower surface of the board by forming a notch at a portion of the board corresponding to the switch operating portions. No extra space corresponding to the thickness of the switches need be provided between the board and the button and box, and the device can be made thin by an amount corresponding to the thickness of the switches.

(3) In the present invention, the switch operating portions are not located immediately below the button press surface. In other words, for example, in FIGS. 3 and 5, no operating portions 4*a* of switches 4 are present but contact guides 1*b* are present immediately below a press surface 2*a* of a button 2. The press surface 2*a* of the button 2 will not be undesirably pressed at two portions simultaneously to turn on both the right and left switches simultaneously.

The above and many other objects, features and advantages of the present invention will become manifest to those skilled in the art upon making reference to the following detailed description and accompanying drawings in which preferred embodiments incorporating the principles of the present invention are shown by way of illustrative example.

BRIEF DESCRIPTION OF THE DRAWINGS

FIGS. 1A and 1B are perspective views of a conventional see-saw switch before assembly, in which FIG. 1A shows a button, and FIG. 1B shows a housing into which the button shown in FIG. 1A is to be pressed;

FIGS. 5A and 5B are sectional views during operation of the button in FIG. 4 of the see-saw button device according to the present invention, in which FIG. 5A shows a case wherein the left press portion of the button is pressed, and FIG. 5B shows a case wherein the right press portion of the button is pressed;

FIGS. 9A and 9B are sectional views during operation of the button in FIG. 8 of the see-saw button device according to the present invention, in which FIG. 9A shows a case wherein the left press portion of the button is pressed, and FIG. 9B shows a case wherein the right press portion of the button is pressed;

FIGS. 13A and 13B are sectional views during operation of the button in FIG. 12 of the see-saw button device according to the present invention, in which FIG. 13A shows a case wherein the left press portion of the button is pressed, and FIG. 13B shows a case wherein the right press portion of the button is pressed.

DETAILED DESCRIPTION OF THE PREFERRED EMBODIMENTS

Several preferred embodiments of the present invention will be described with reference to the accompanying drawings.

(1) First Embodiment

Figure 1A:
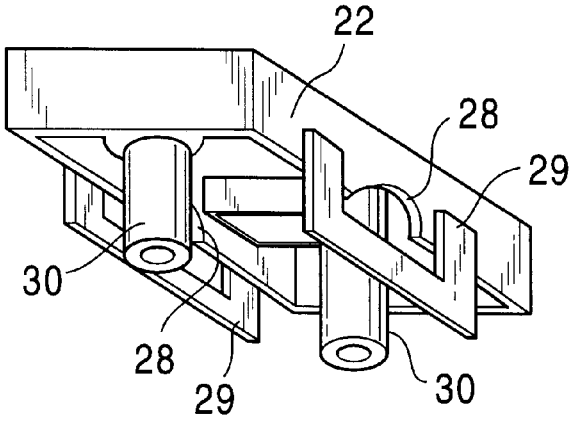
FIG. 1A PRIOR ART
Figure 1B:
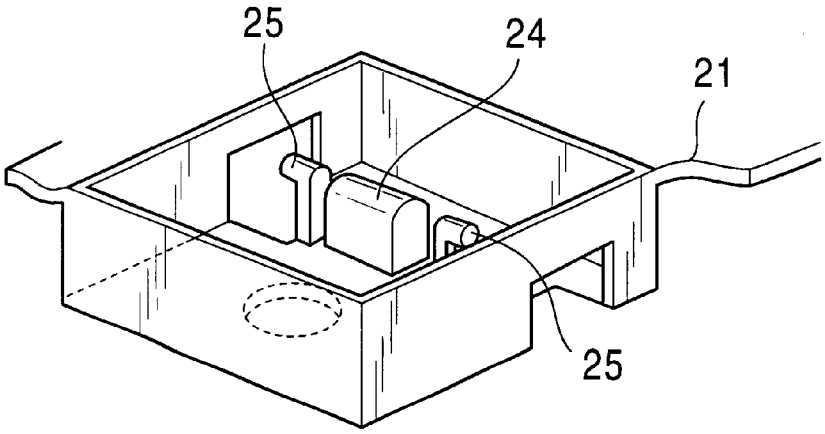
FIG. 1B PRIOR ART
Figure 2:
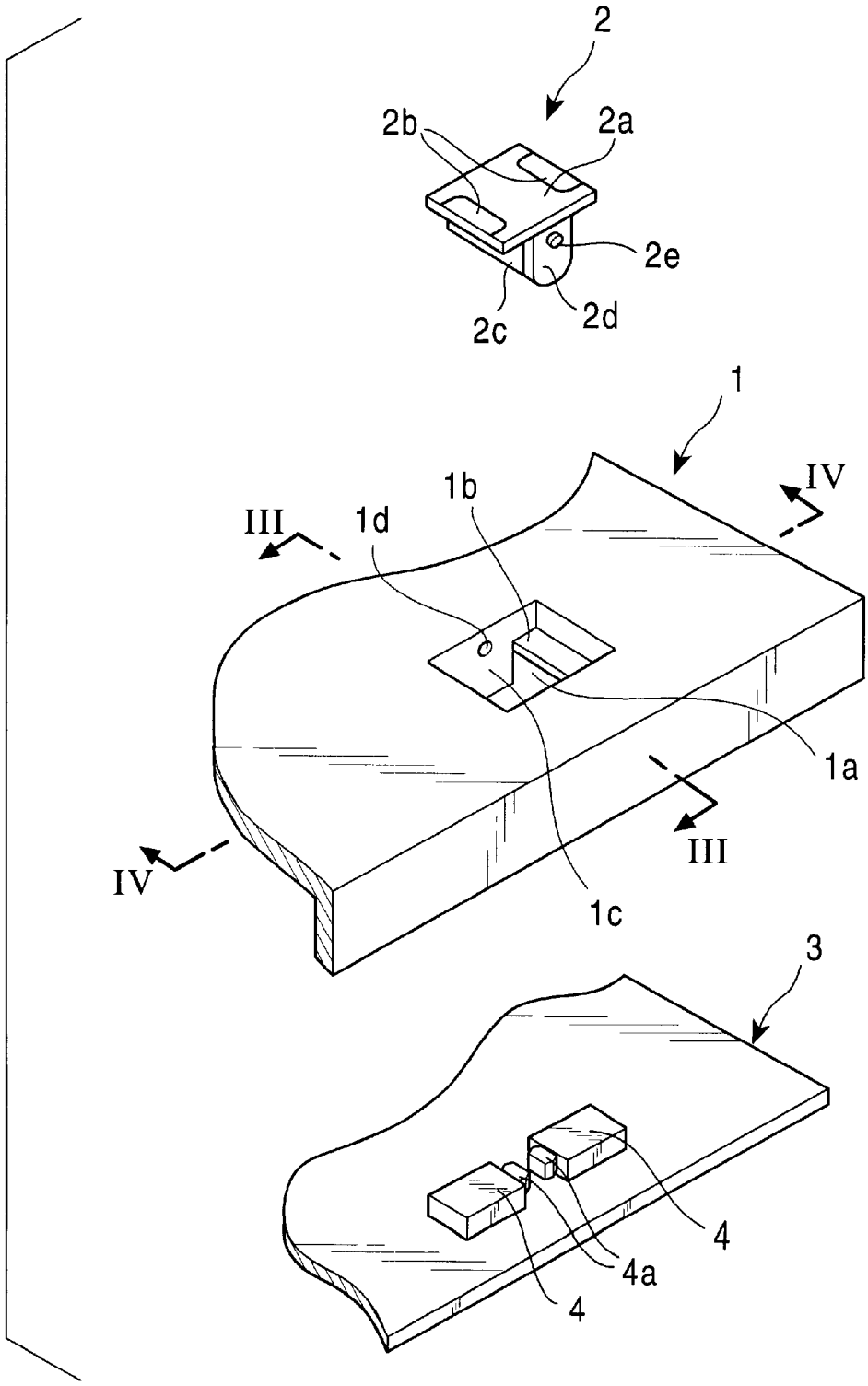
FIG. 2 is an exploded perspective component view of a see-saw button device for electronic equipment according to an embodiment of the present invention.

FIG. 2 is an exploded perspective component view of a see-saw button device for electronic equipment according to an embodiment of the present invention.

This see-saw button device is constituted by a box 1 on which a button 2 is to be mounted, and a board 3 on which push switches 4 are to be mounted. The box 1 has a notch 1*a* slightly larger than a press surface 2*a* of the button 2. Contact guides 1*b* for suppressing operation of the button 2 are formed inside the notch 1*a*. The lower portion of the central portion of each side surface of the notch 1*a* forms a rib 1*c* used for positioning the board 3. Bearings 1*d* for holding the shafts 2*e* on ribs 2*d* of the button 2 are formed on the respective ribs 1*c*.

The button 2 has a rib 2*c* at the center of the two press portions on the lower surface of its press surface 2*a*. Ribs 2*d* are formed on the two side surfaces of the rib 2*c* to increase the strength of the rib 2*c*. The ribs 2*d* respectively have semicircular distal ends so that the button 2 will not come into contact with the ribs 2*d* when it performs a see-saw motion. The shafts 2*e* serving as the fulcrum of the see-saw motion are formed on the respective ribs 2*d*. The button 2 and box 1 are made of an insulator or the like, and the board 3 is made of a ceramic material.

Two switches 4, each having an operating portion 4*a* on its side surface and made of a metal or the like, are mounted on the board 3 such that their operating portions 4*a* oppose each other.

Figure 3:
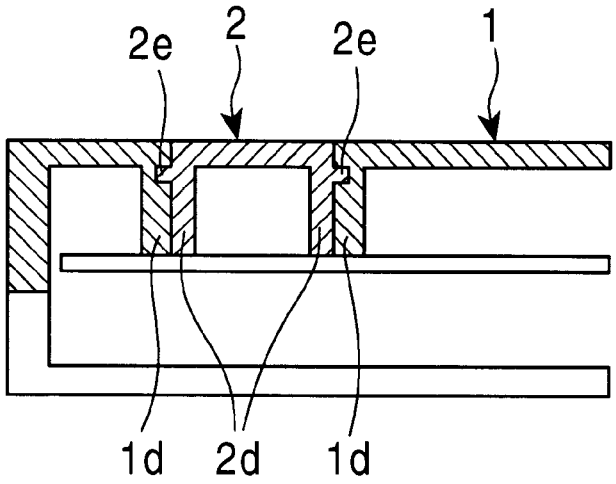
FIG. 3 is a sectional view taken along the line III—III of FIG. 2 in a state wherein the respective components are assembled together.

FIG. 3 is a sectional view taken along the line III—III of FIG. 2 in a state wherein the respective components are assembled together.

Referring to FIG. 3, the button 2 is pressed into the box 1 from above, and the shafts 2*e* of the button 2 are fitted in the bearings 1*d* of the box 1 and are fixed there.

Figure 4:
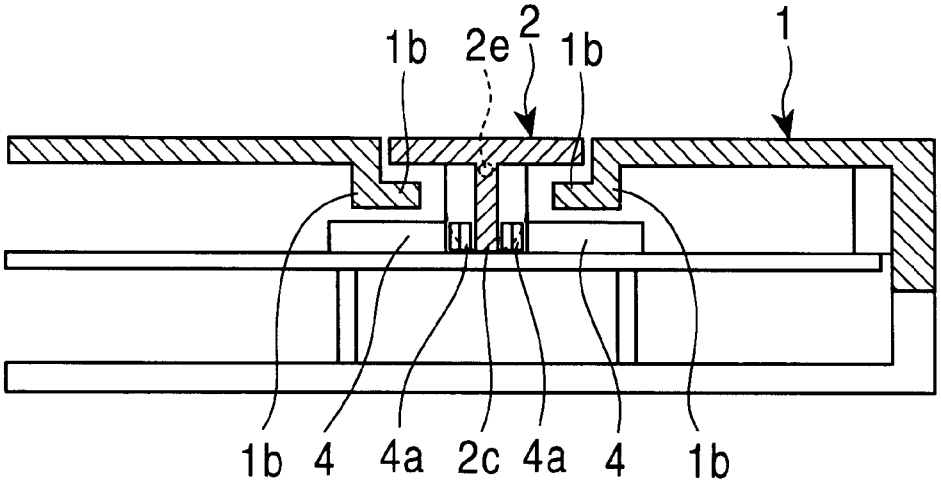
FIG. 4 is a sectional view taken along the line IV—IV of FIG. 2 in a state wherein the respective components are assembled together.

FIG. 4 is a sectional view taken along the line IV—IV of FIG. 2 in a state wherein the respective components are assembled together.

When the button 2 is pressed into the box 1 from above, the rib 2*c* of the button 2 is located between the two switches 4 mounted on the board 3, and the distance between the two switches 4 is larger than the thickness of the rib 2*c* of the button 2.

The see-saw button device having the above arrangement operates in the following manner.

Figure 5A:
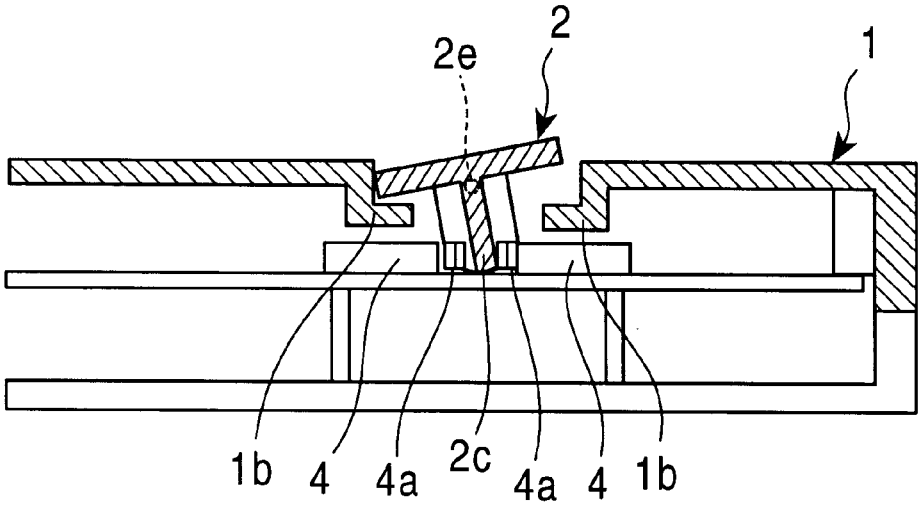
Figure 5B:
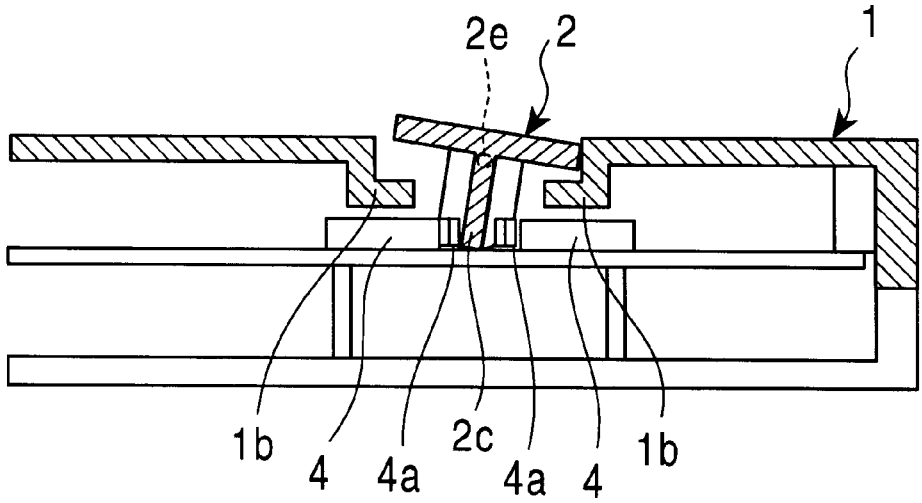

FIGS. 5A and 5B are sectional views during operation of the button in FIG. 4 of the see-saw button device according to the present invention, in which FIG. 5A shows a case wherein the left press portion of the button is pressed, and FIG. 5B shows a case wherein the right press portion of the button is pressed.

When a left press portion 2*b* of the button 2 is pressed, the rib 2*c* presses the operating portion 4*a* of the right switch 4 upon rotation about the shafts 2*e* of the button 2 as the fulcrum, to actuate this switch 4. When the left press portion 2*b* of the button 2 is released, the button 2 is restored to the original position shown in FIG. 3 by the restoring force of the operating portion 4*a* of the corresponding switch 4. When a right press portion 2*b* of the button 2 is pressed, it operates in a manner symmetric with the above description, and a description for it will be omitted accordingly.

(2) Second Embodiment

Figure 6:
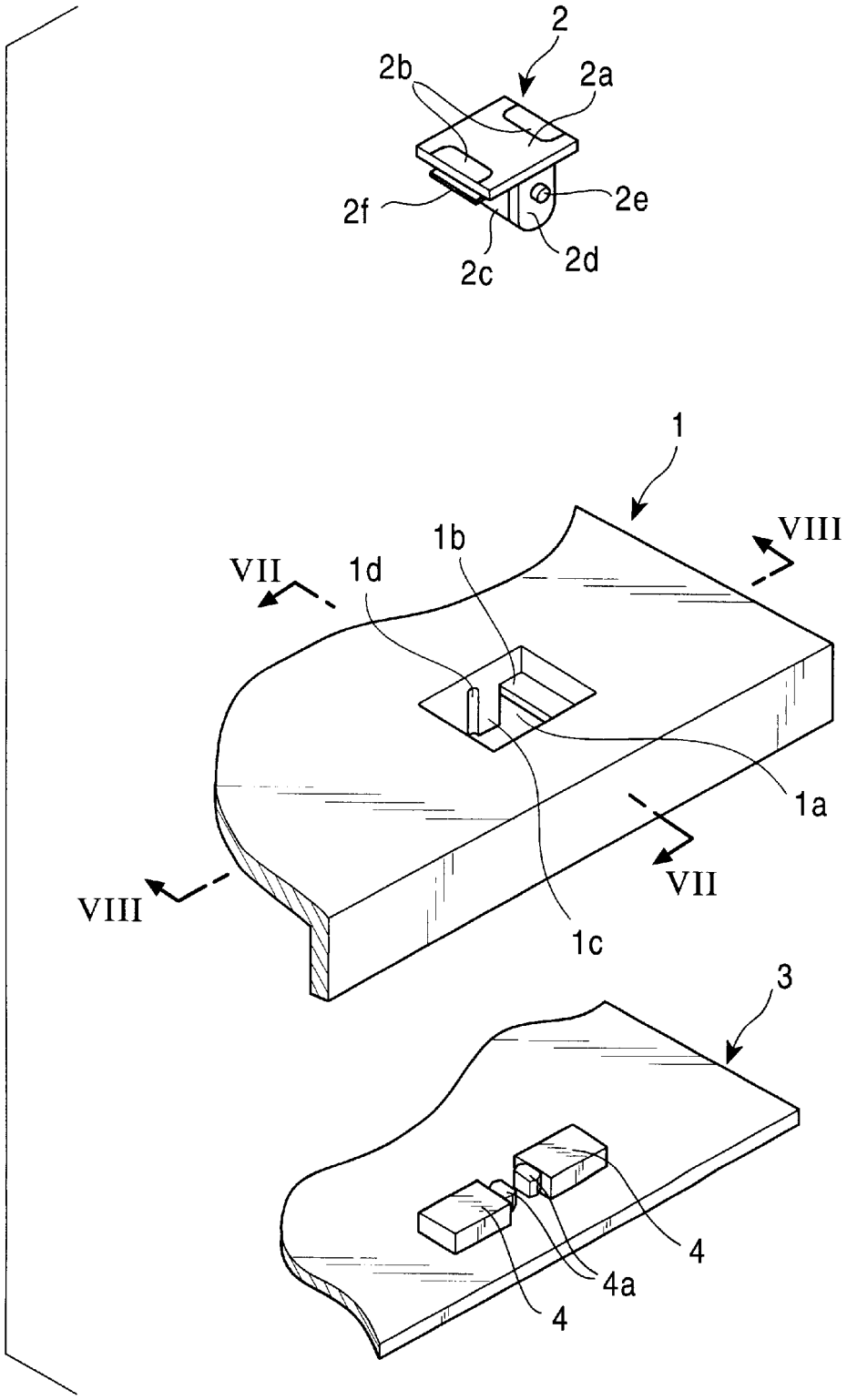
FIG. 6 is an exploded perspective component view of a see-saw button device for electronic equipment according to another embodiment of the present invention.

FIG. 6 is an exploded perspective component view of a see-saw button device for electronic equipment according to another embodiment of the present invention.

A box 1 has a notch 1*a* slightly larger than a press surface 2*a* of a button 2. Contact guides 1*b* that come into contact with cantilevered elastic members 2*f* of the button 2 are formed inside the notch 1*a*. The lower portion of the central portion of each side surface of the notch 1*a* forms a rib 1*c* used for positioning a board 3. Groove bearings 1*d* for holding shafts 2*e* on ribs 2*d* of the button 2 are formed on the respective ribs 1*c*.

The button 2 has a rib 2*c* at the center of the two press portions on the lower surface of its press surface 2*a*. The ribs 2*d* are formed on the two side surfaces of the rib 2*c* to increase the strength of the rib 2*c*. The ribs 2*d* respectively have semicircular distal ends so that the button 2 will not come into contact with the ribs 2*d* when it performs a see-saw motion. The shafts 2*e* serving as the fulcrum of the see-saw motion are formed on the respective ribs 2*d*. The cantilevered elastic members 2*f* project from the rib 2*c* on the two sides of the see-saw motion.

Two switches 4, each having an operating portion 4*a* on its side surface, are mounted on the board 3 such that their operating portions 4*a* oppose each other.

Figure 7:
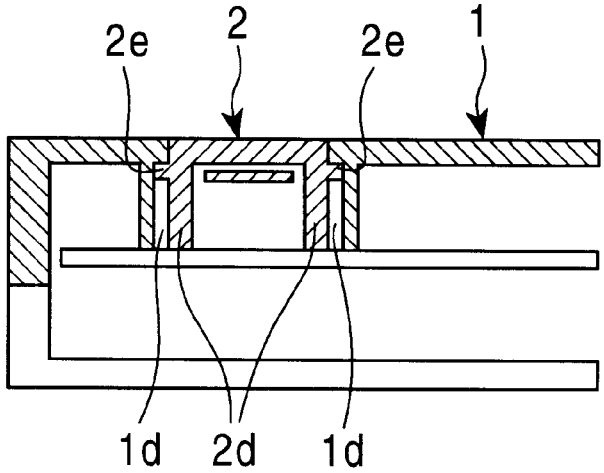
FIG. 7 is a sectional view taken along the line VII— VII of FIG. 6 in a state wherein the respective components are assembled together.

FIG. 7 is a sectional view taken along the line VII—VII of FIG. 6 in a state wherein the respective components are assembled together.

Referring to FIG. 7, the button 2 is pressed into the box 1 from above, and the shafts 2*e* of the button 2 are fitted in the bearings 1*d* of the box 1 and are fixed there.

Figure 8:
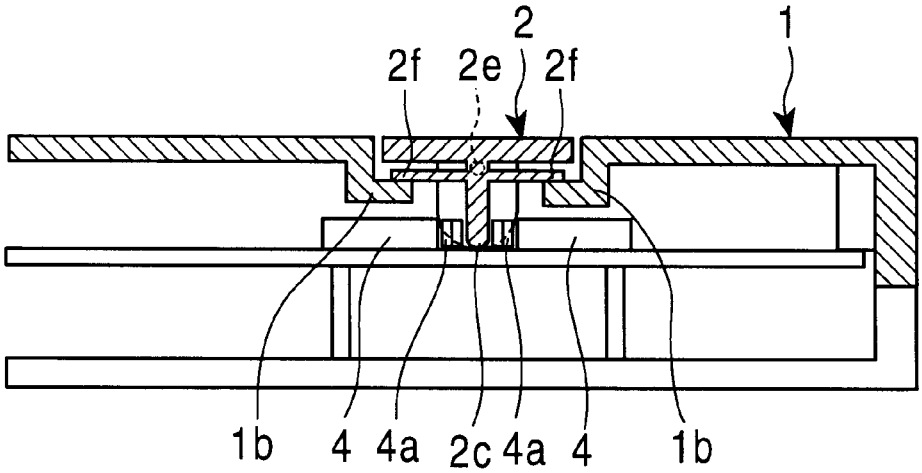
FIG. 8 is a sectional view taken along the line VIII—VIII of FIG. 6 in a state wherein the respective components are assembled together.

FIG. 8 is a sectional view taken along the line VIII—VIII of FIG. 6 in a state wherein the respective components are assembled together.

When the button 2 is pressed into the box 1 from above, the lower surfaces of the two cantilevered elastic members 2*f* of the button 2 come into contact with the upper surfaces of the contact guides 1*b* of the box 1 simultaneously and slightly elastically deform, so that the button 2 clamps the box 1 with its shafts 2*e* and cantilevered elastic members 2*f*. The rib 2*c* of the button 2 is located between the two switches 4 mounted on the board 3.

Figure 9A:
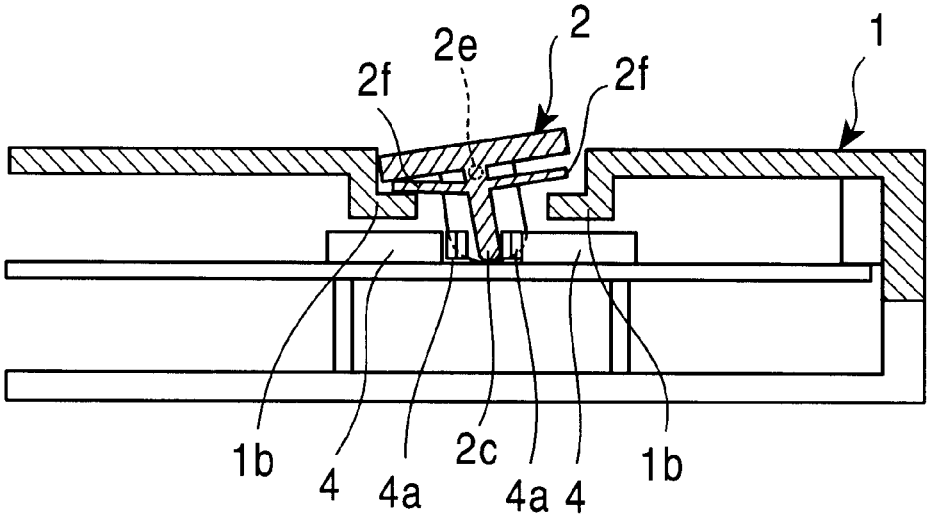
Figure 9B:
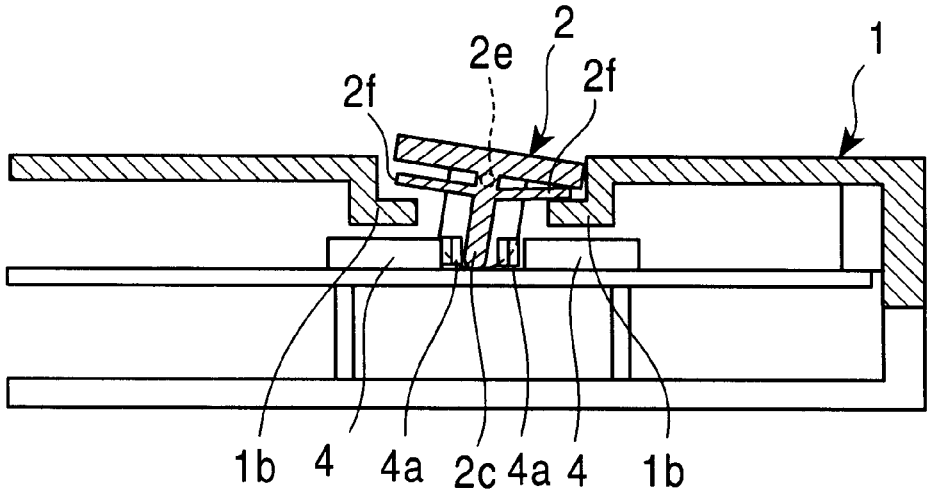

FIGS. 9A and 9B are sectional views during operation of the button in FIG. 8 of the see-saw button device according to the present invention, in which FIG. 9A shows a case wherein the left press portion of the button is pressed, and FIG. 9B shows a case wherein the right press portion of the button is pressed.

When a left press portion 2*b* of the button 2 is pressed, the rib 2*c* presses the operating portion 4*a* of the right switch 4 upon rotation about the shafts 2*e* of the button 2 as the fulcrum, to actuate this switch 4. At this time, the lower surface of the right cantilevered elastic member 2*f* of the button 2 is separated from the upper surface of the corresponding contact guide 1*b* of the box 1, while the lower surface of the left cantilevered elastic member 2*f* is urged by the upper surface of the corresponding contact guide 1*b* of the box 1 and thus elastically deforms. When the left press portion 2*b* of the button 2 is released, the button 2 is restored to the original position shown in FIG. 7 by the restoring force of the left cantilevered elastic members 2*f* and of the operating portion 4*a* of the corresponding switch 4. When a right press portion 2*b* of the button 2 is pressed, it operates in a manner symmetric with the above description, and a description for it will be omitted accordingly.

(3) Third Embodiment

Figure 10:
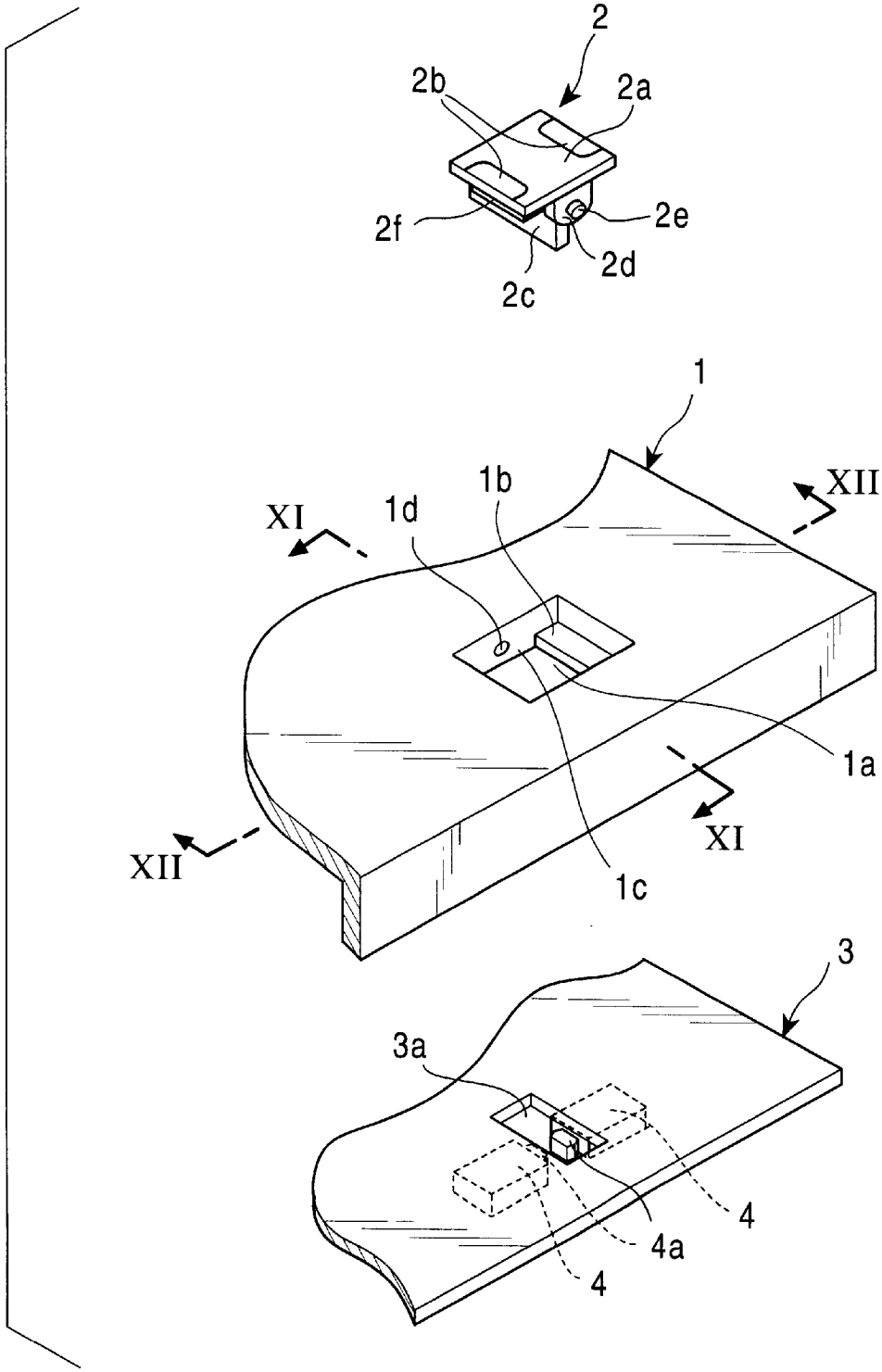
FIG. 10 is an exploded perspective component view of a see-saw button device for electronic equipment according to still another embodiment of the present invention.

FIG. 10 is an exploded perspective component view of a see-saw button device for electronic equipment according to still another embodiment of the present invention.

A box 1 has a notch 1*a* slightly larger than a press surface 2*a* of a button 2. Contact guides 1*b* that come into contact with cantilevered elastic members 2*f* of the button 2 are formed inside the notch 1*a*. The lower portion of the central portion of each side surface of the notch 1*a* forms a rib 1*c* used for positioning a board 3. Groove bearings 1*d* for holding shafts 2*e* on ribs 2*d* of the button 2 are formed on the respective ribs 1*c*.

The button 2 has a rib 2*c* at the center of the two press portions on the lower surface of its press surface 2*a*. The ribs 2*d* are formed on the two side surfaces of the rib 2*c* to increase the strength of the rib 2*c*. The ribs 2*d* respectively have semicircular distal ends so that the button 2 will not come into contact with the ribs 2*d* when it performs a see-saw motion. The shafts 2*e* serving as the fulcrum of the see-saw motion are formed on the respective ribs 2*d*. The cantilevered elastic members 2*f* project from the rib 2*c* on the two sides of the see-saw motion.

A notch 3*a* is formed in the board 3 at a portion corresponding to switch operating portions. Two switches 4, each having an operating portion 4*a* on its side surface, are mounted on the lower surface of the board 3 at such positions that the operating portions 4*a* can be seen from the notch 3*a* of the board 3. The operating portions 4*a* oppose each other.

Figure 11:
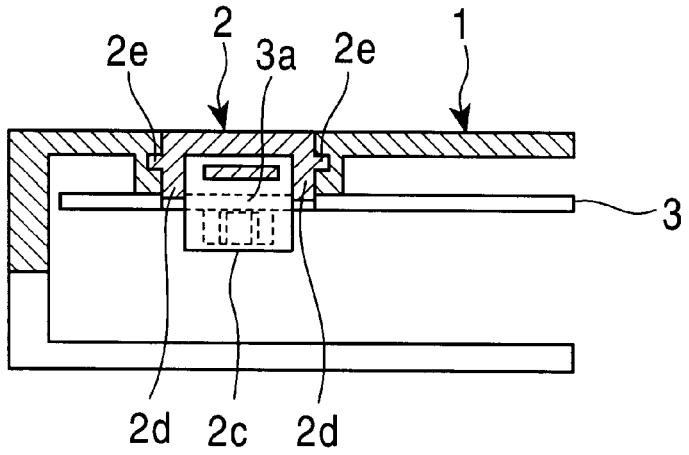
FIG. 11 is a sectional view taken along the line XI—XI of FIG. 10 in a state wherein the respective components are assembled together.

FIG. 11 is a sectional view taken along the line XI—XI of FIG. 10 in a state wherein the respective components are assembled together.

Referring to FIG. 11, the button 2 is pressed into the box 1 from above, and the shafts 2*e* of the button 2 are fitted in the bearings 1*d* of the box 1 and are fixed there.

Figure 12:
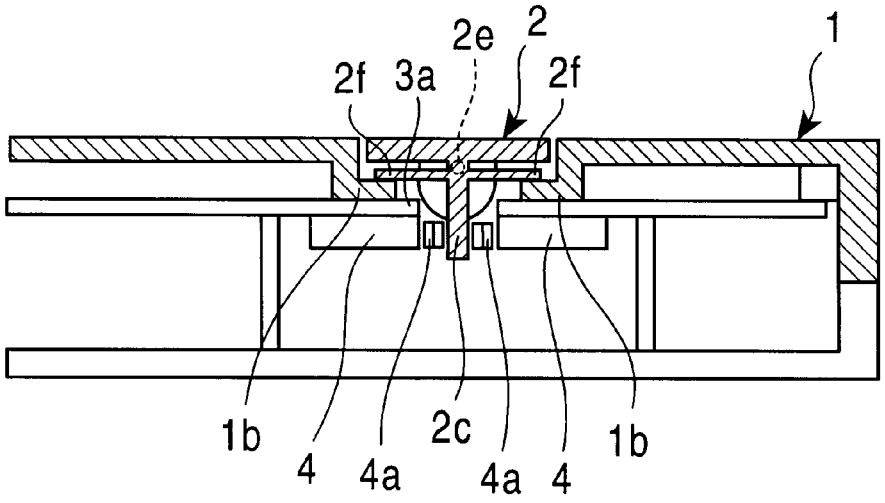
FIG. 12 is a sectional view taken along the line XII—XII of FIG. 10 in a state wherein the respective components are assembled together.

FIG. 12 is a sectional view taken along the line XII—XII of FIG. 10 in a state wherein the respective components are assembled together.

When the button 2 is pressed into the box 1 from above, the lower surfaces of the two cantilevered elastic members 2*f* of the button 2 come into contact with the upper surfaces of contact guides 1*b* of the box 1 simultaneously and slightly elastically deform, so that the button 2 clamps the box 1 with its shafts 2*e* and cantilevered elastic members 2*f*. The rib 2*c* of the button 2 passes through the notch 3*a* of the board 3 and is located between the two switches 4 mounted on the lower surface of the board 3.

Figure 13A:
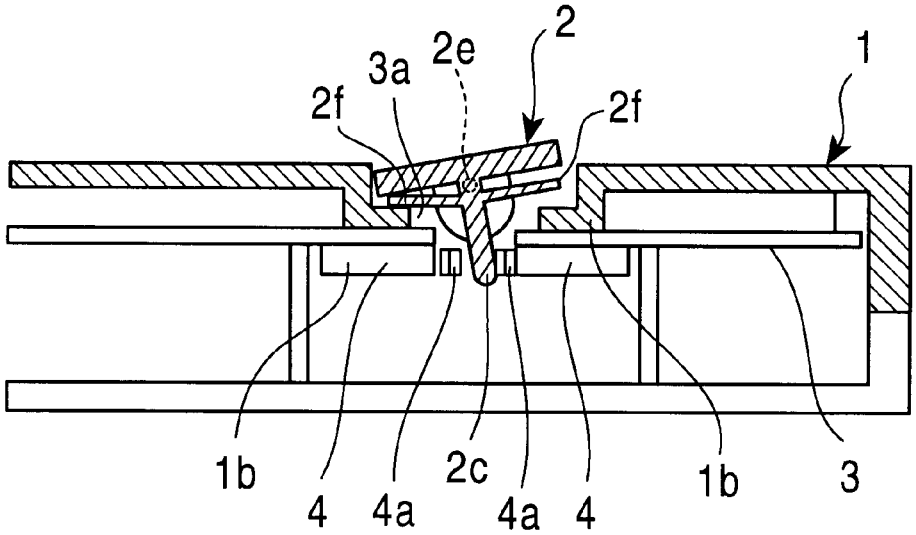
Figure 13B:
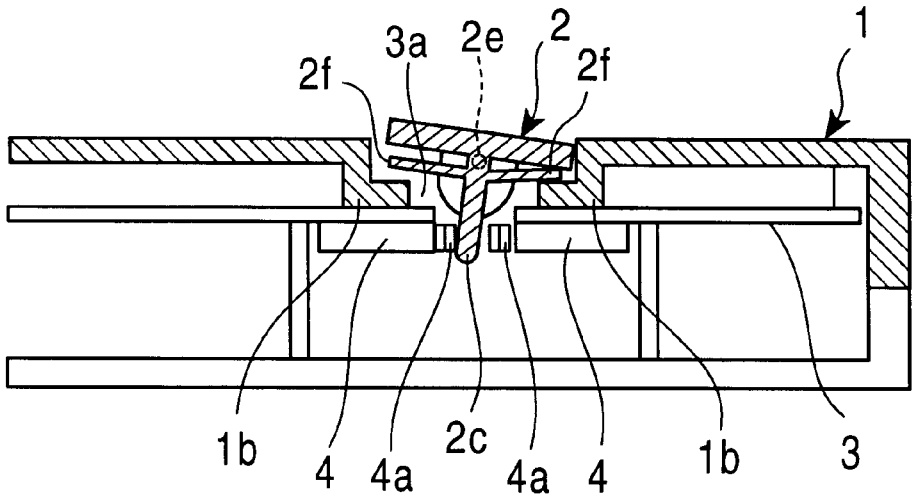

FIGS. 13A and 13B are sectional views during operation of the button in FIG. 12 of the see-saw button device according to the present invention, in which FIG. 13A shows a case wherein the left press portion of the button is pressed, and FIG. 13B shows a case wherein the right press portion of the button is pressed.

When a left press portion 2*b* of the button 2 is pressed, the rib 2*c* presses the operating portion 4*a* of the right switch 4 upon rotation about the shafts 2*e* of the button 2 as the fulcrum, to actuate this switch 4. At this time, the lower surface of the right cantilevered elastic member 2*f* of the button 2 is separated from the upper surface of the corresponding contact guide 1*b* of the box 1, while the lower surface of the left cantilevered elastic member 2*f* is urged by the upper surface of the corresponding contact guide 1*b* of the box 1 and thus elastically deforms. When the left press portion 2*b* of the button 2 is released, the button 2 is restored to the original position shown in FIG. 7 by the restoring force of the left cantilevered elastic members 2*f* and of the operating portion 4*a* of the corresponding switch 4. When a right press portion 2*b* of the button 2 is pressed, it operates in a manner symmetric with the above description, and a description for it will be omitted accordingly.

What is claimed is:

1. A see-saw button device for electronic equipment including a box fitted with a button and a board mounted with two switches, wherein said button has two press portions thereon, shafts serving as a see-saw fulcrum of said button are provided along a rib formed at an intermediate portion of said two button press portions, said two switches each having an operating portion on an end face thereof are mounted on said board such that said operating portions oppose each other, said two switches are separated by a distance larger than a thickness of said rib of said button, cantilevered elastic members projecting from two sides of said rib of said button in a see-saw operating direction and each of said cantilevered elastic members having a size not larger than that of a button press surface, a contact portion being formed in a notch where said button of said box is to be mounted, and at least one of said cantilevered elastic members being constantly in contact with said contact portion.

2. A device according to claim 1, wherein a lower surface of at least one of said elastic members of said button is constantly in contact with an upper surface of said contact portion of said box.

3. A device according to claim 1, wherein said switches are formed on a lower surface of said board.

4. A device according to claim 1, wherein said button is point-symmetrical with respect to a center of a press surface thereof.

5. A device according to claim 1, wherein each of said bearings is a groove formed to fit with said shafts formed along said rib of said button.

* * * * *